United States Patent [19]

Luongo

[11] Patent Number: 4,979,381

[45] Date of Patent: Dec. 25, 1990

[54] POWER DRIVE LOCKING SYSTEM

[75] Inventor: Douglas J. Luongo, North Lauderdale, Fla.

[73] Assignee: Nautic Marine Security Systems Inc., Pompano Beach, Fla.

[21] Appl. No.: 517,316

[22] Filed: May 1, 1990

[51] Int. Cl.[5] ..... E05B 65/00

[52] U.S. Cl. ..... 70/57; 70/14; 70/19

[58] Field of Search ..... 70/57, 58, 14, 19; 292/288

[56] References Cited

U.S. PATENT DOCUMENTS 2,556,900 6/1951 Buschhorn ..... 70/19
2,597,583 5/1952 Holmsten ..... 70/89
4,372,136 2/1983 Mickelson ..... 70/14
4,389,862 6/1983 Hastings ..... 70/19

*Primary Examiner*—Robert L. Wolfe
*Attorney, Agent, or Firm*—Alvin S. Blum

[57] ABSTRACT

To prevent theft of an outdrive unit by removal from a bell housing mounted on the transom of a boat, a padlock holds together a pair of bent bars. The bars are made of a heavy stainless steel. Each bar hooks around an edge of the bell housing, wraps around one side of the bell housing and outdrive unit, and then crosses in front of the outdrive unit. When held together by the padlock, the bars cannot be unhooked from the bell housing and the outdrive cannot be pulled off the mounting studs projecting from the bell housing.

3 Claims, 1 Drawing Sheet

POWER DRIVE LOCKING SYSTEM

BACKGROUND OF THE INVENTION

This invention relates to security devices for cooperation with a lock to prevent theft of equipment and more particularly to locking apparatus that removably engages the power outdrive of a boat to prevent unauthorized removal.

Boats may be powered by one or more engines mounted within the boat that have a horizontal output shaft connected to a power drive assembly mounted on the transom. The power drive assembly carries the output power through the transom horizontally, then turns it vertically down to a point below the bottom where it is then turned horizontally to drive a propeller. The power drive has a gimbal arrangement to permit rotation about a vertical exis for steering and about a horizontal axis for tilting. In certain power drive assemblies, a bell housing is connected to the gimbal mountings secured to the transom. The movable power drive apparatus, herein referred to as the outdrive unit, is then fastened to the bell housing by slipping it onto studs projecting from the bell housing and securing with nuts on the studs. The bell housing with outdrive attached now is gimbal mounted to the transom for steering and tilting and is ready for operation. Unfortunately, it is just as easy to remove the outdrive unit by removing these nuts. The outdrive units are valued at thousands of dollars. They have become a convenient target for thieves, since outdrives frequently need expensive maintenance or replacement in ordinary use. The theft problem has become so bad in certain areas that boat owners and dealers are forced to remove their outdrive units when unattended.

SUMMARY OF THE INVENTION

It is accordingly an object of the invention to provide apparatus for preventing the unauthorized removal of an outdrive unit from a bell housing, or at least to greatly increase the difficulty of doing so, without making it difficult for the authorized user to remove the outdrive. It is another object to provide apparatus to accomplish this purpose that may be easily installed without tools or special skills.

The locking system of the invention comprises a pair of bent stainless steel bars that each hook onto a side of the bell housing and bend around the outdrive where they meet centrally. At the point of meeting, each bar has a hole. The holes are arranged to receive a padlock. When the padlock is locked, the two bars cannot be unhooked from the bell housing. Furthermore, because they fit snugly around the outdrive unit, the outdrive unit cannot be pulled off its mounting studs after the securing nuts are removed from the studs. Consequently, the outdrive unit cannot be stolen by the usual methods. Because the bars are heavy stainless steel, they can only be removed by sawing through them.

When more drastic and attention-attracting methods are required for removal, thieves generally leave in search of easier prey.

These and other objects, advantages and features of the invention will become more apparent when the detailed description is considered in conjunction with the accompanying drawings.

DETAILED DESCRIPTION OF THE PREFERRED EMBODIMENT

Figure 3:
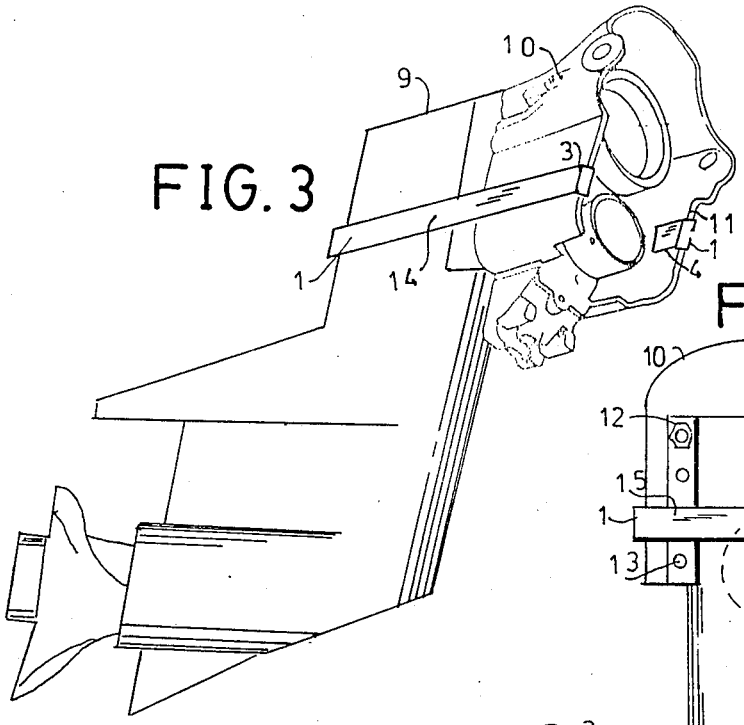
FIG. 3 is a perspective view of the invention in use on a power drive.
Figure 4:
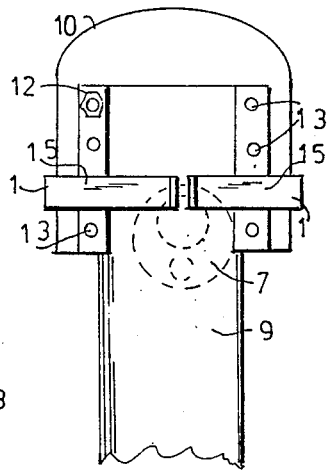
FIG. 4 is a rear view of the power drive with the invention in use.
Figure 1:
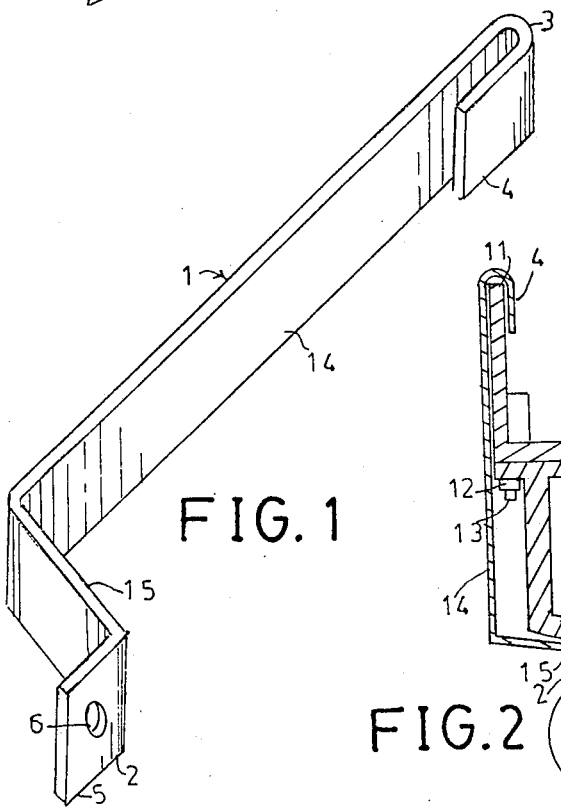
FIG. 1 is a perspective view of one bar.
Figure 2:
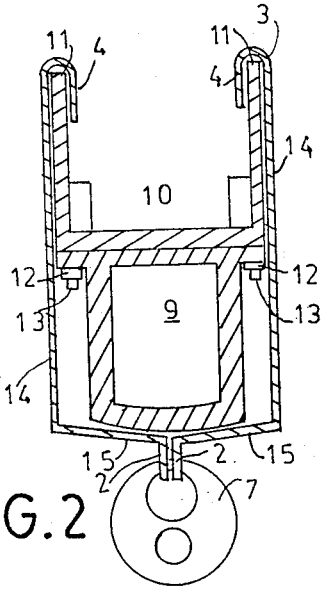
FIG. 2 is a plan view of the two bars with lock in place.

Referring now first to FIGS. 1 and 2, the invention comprises two rigid bars, preferrably formed of one-eighth inch by one-and one- and one-quarter inch stainless bar stock or heavier for maximum rigidity and resistance to burglars. The two bars are substantially identical to reduce production costs. Each bar 1 has an anterior end 2 termninating in a forward projection 5 having an aperture 6 for receiving padlock 7 which passes through both apertures 6 when the forward projections 5 of both bars are brought together from each side of the outdrive unit 9 after the hooks 4 at the posterior ends 3 of both bars have been hooked around the edges 11 of the two sides of the bell housing 10. In order to unhook the bars, the anterior ends 2 must be moved apart far enough so that they will be free of the outdrive unit 9. As long as the padlock prevents this, they cannot be unhooked. While these bars are in place, the outdrive unit 9 cannot be pulled away from the bell housing 10 even when the nuts 12 have been removed from studs 13. Each bar 1 has an intermediate portion 14 that fits along the side of outdrive unit 9 and bell housing 10 and a blocking portion 15, substantially at right angles to the intermediate portion 14 that blocks the movement of outdrive unit 9 away from bell housing 10. If the outdrive unit 9 cannot be pulled away, then the studs 13 projecting from the bell housing will not clear the holes in outdrive unit 9 through which they pass. This impediment to theft makes the entire assembly relatively secure. With the correct key, the padlock is opened and each bar removed in a moment. Alternatively, the invention can be left in place since it does not interfere with operation of the power drive.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed:

1. In a power drive locking system employing a padlock for preventing the unauthorized removal of an outdrive unit from a bell housing mounted on a boat transom, the improvement comprising:

a pair of rigid, elongate bars constructed of a material resistant to cutting and bending, each said bar including: two ends, a first end terminating in a hook arrranged to fit around an edge on one side of said bell housing; an intermediate portion connected to said first end, said intermediate portion arranged to lie along a side of said bell housing and said outdrive unit while said edge is engaged by said hook; a blocking portion connected to said intermediate portion and forming an angle of between about ninety degrees and one hundred and twenty degrees thereto; a second end connected to said blocking portion and substantially parallel to said intermediate portion; and an aperture in said second end, wherein said apertures in said second ends are alignable to receive said padlock to prevent disengagement of said hooks and said blocking portions arranged to prevent separation of said outdrive unit from said bell housing while said edges are engaged by said hooks.

2. The system according to claim 1, in which said material is stainless steel.

3. The system according to claim 1, in which said bar is constructed of stainless steel bar having dimensions no less than one eigth inch by one and one eighth inches.

* * * * *